United States Patent [19]

Janssen et al.

[11] Patent Number: 5,001,388

[45] Date of Patent: Mar. 19, 1991

[54] DOUBLE-ENDED LAMP INCLUDING LAMP CAP AT EACH END

[75] Inventors: Eduard J. P. Janssen; Victor R. Notelteirs, both of Turnhout, Belgium

[73] Assignee: U.S. Philips Corporation, New York, N.Y.

[21] Appl. No.: 347,316

[22] Filed: May 3, 1989

[30] Foreign Application Priority Data

Jun. 9, 1988 [NL] Netherlands ..... 8801480

[51] Int. Cl.[5] ..... H01J 5/58

[52] U.S. Cl. ..... 313/318; 313/315; 439/612

[58] Field of Search ..... 313/318, 315, 49, 51; 439/239, 612, 226, 280

[56] References Cited

U.S. PATENT DOCUMENTS 4,069,437 1/1978 Notelteirs et al. ..... 313/315

4,751,422 6/1988 Morianz et al. ..... 313/318

FOREIGN PATENT DOCUMENTS 715479 9/1954 United Kingdom ..... 313/49

2203020 10/1988 United Kingdom .

*Primary Examiner*—Donald J. Yusko

*Assistant Examiner*—Michael Horabik

*Attorney, Agent, or Firm*—R. J. Kraus

[57] ABSTRACT

The electric lamp has ceramic lamp caps (7, 8) secured to the lamp vessel (1) without the use of cement. This is realized by securing the cable (9) to the current supply conductor (5) after the lamp cap (7) has been provided. Securing is made possible by the shape of the lamp cap (7) which has a cavity (13) for the seal (2) of conductor (5), which duct runs into a recess (14) for the cable (9). A bore (15) enables the cable (9) to be connected to the current supply conductor (5) after the lamp cap (7) has been provided.

2 Claims, 1 Drawing Sheet

DOUBLE-ENDED LAMP INCLUDING LAMP CAP AT EACH END

BACKGROUND OF THE INVENTION

The invention relates to an electric lamp comprising a translucent lamp vessel which is sealed in a vacuum-tight manner and has a seal at its ends, an electric element in the lamp vessel, current supply conductors which are passed to the electric element through a respective seal, ceramic lamp caps each having a cavity at least partly accommodating a respective seal, electrically conducting cables having a first end secured to a respective current supply conductor, said cables being passed to the exterior through an opening in the relevant lamp cap transversely to the relevant current supply conductor.

A lamp of this type is known from and described in GB No. 2,203,020, to which U.S. Pat. No. 4,894,519 corresponds.

In the known lamp the ceramic lamp caps are secured to the seals of the lamp vessel by means of cement. It has been found that the seals in such a lamp may break owing to mechanical stresses caused by the use of cement. In fact, lamps to which cables are secured are often used for purposes at which the seals assume a relatively high temperature during operation of the lamp. The lamp may also break easily when it is placed in a luminaire holding the lamp at its lamp caps.

SUMMARY OF THE INVENTION

It is an object of the invention to provide a lamp of the type described in the opening paragraph, which has a simple lamp cap secured without the use of cement.

According to the invention this object is realised in that each ceramic lamp cap comprises a duct which is accessible from the cavity of the lamp cap and accommodates the relevant current supply conductor, a recess which is transverse to the duct and accommodates the first end of the relevant cable, said recess crossing the duct at a distance from the cavity, a bore which is transverse to the recess and the duct and in which the recess crosses the duct and in which the electric cable is secured to the current supply conductor.

In the lamp according to the invention a lamp cap is secured to the lamp vessel when the cable is secured to the relevant current supply conductor. The lamp cap has the bore to enable the cable to be secured while the lamp cap has already been positioned. A welded or soldered joint can be made via this bore. After this joint has been made, the lamp cap and the lamp vessel are undetachably coupled. Consequently, this coupling does not require cement or any other means. The only component that is required is the specially shaped lamp cap.

The lamp cap may laterally surround the seal on only two opposite sides, or, in another embodiment, it may laterally surround the seal circumferentially.

The electric element may be a filament or an electrode pair.

BRIEF DESCRIPTION OF THE DRAWINGS

An embodiment of the lamp according to the invention will now be described in greater detail with reference to the accompanying drawing.

In this drawing

DESCRIPTION OF THE PREFERRED EMBODIMENT

Figure 1:
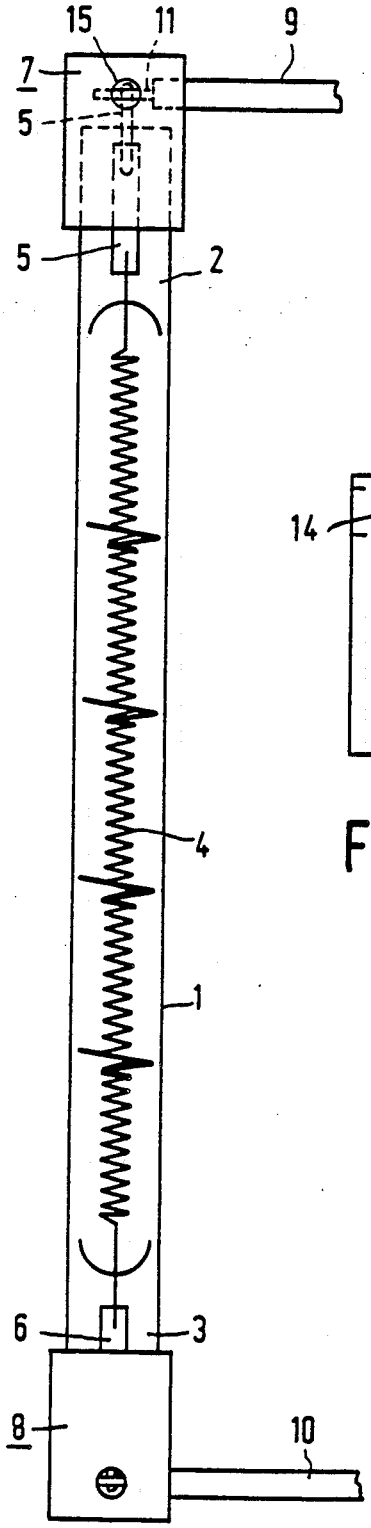
FIG. 1 shows a lamp in a side elevation.
Figure 2:
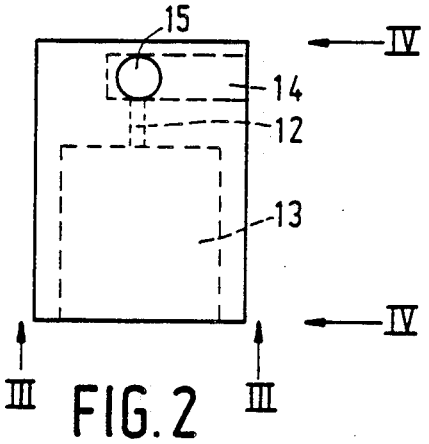
FIG. 2 shows a lamp cap of FIG. 1 on a larger scale in a side elevation.

The electric lamp of FIG. 1 has a translucent lamp vessel 1 which is sealed in a vacuum-tight manner and which has seals 2, 3 at its ends. The lamp vessel 1 accommodates a filament as an electric element 4 to which current supply conductors 5, 6 are connected which are passed through the seals 2, 3, respectively. The lamp has ceramic lamp caps 7, 8 each having a cavity 13 (FIG. 2) which at least partly accommodates a respective seal 2, 3. Electrically conducting cables 9, 10 have a first end 11 secured to a respective current supply conductor 5, 6. The cables 9, 10 are passed to the exterior through an opening in the relevant lamp cap 7, 8 transversely to the relevant current supply conductor 5, 6.

Figure 3:
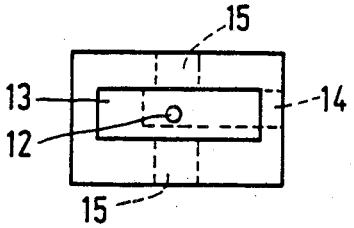
FIG. 3 shows the lamp cap of FIG. 2 in an elevation taken on the line III—III in FIG. 2.
Figure 4:
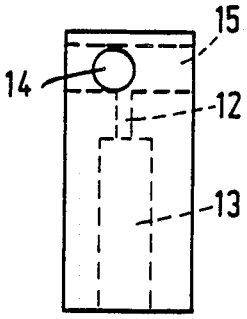
FIG. 4 shows the lamp cap of FIG. 2 in a side elevation taken on the line IV—IV in FIG. 2.

Each ceramic lamp cap 7, 8 has a duct 12 (FIGS. 2–4) which is accessible from the cavity 13 of this lamp cap 7, 8 which accommodates a seal 2, 3 (FIG. 1). This duct 12 accommodates the relevant current supply conductor 5, 6. The lamp cap 7, 8 has a recess 14 transverse to the duct 12, which recess 14 accommodates the first end 11 of the relevant cable 9 and crosses the duct 12 at a distance from the cavity 13. The lamp cap 7, 8 also has a bore 15 which is transverse to the recess 14 and the duct 12 in which the recess crosses the duct and in which the current supply conductors 5, 6 are secured to the cables 9, 10, respectively.

The cables 9, 10 are secured to the current supply conductors 5, 6 via the bore 15, after the lamp caps 7, 8 have been arranged on the lamp vessel 1. The cables 9, 10 fix the lamp caps 7, 8 on the lamp vessel 1 without additional means.

The lamp caps 7, 8 laterally surround the respective seals 2, 3 circumferentially because, apart from the duct 12, the cavity 13 is open on one side only.

We claim:

1. An electric lamp comprising:

a. a lamp vessel which is sealed in a vacuum-tight manner and has respective seals at first and second ends thereof;

b. an electric element disposed in the lamp vessel;

c. first and second current supply conductors passing through respective ones of the seals to the electric element; and d. first and second lamp caps of insulating material, each including a cavity for receiving a respective one of the seals and a first opening for receiving an electrically conductive cable to be electrically connected to a respective one of the current supply conductors;

characterized in that each of the lamp caps includes means for securing said cap to one of the ends of the lamp vessel without affixing said cap to the respective seal, said means comprising:

e. a duct communicating with the cavity for receiving the current supply conductor passing through said seal;

f. a recess, extending transversely to the duct from the first opening in the lamp cap for receiving the electrically conductive cable, said recess being positioned in said lamp cap to cross said duct at a predetermined location adjacent the current supply conductor; and g. a bore extending transversely to both the duct and the recess from a second opening in the lamp cap to the predetermined location, said bore providing an access through which the cable is electrically connected to the current supply conductor, thereby securing the lamp cap to the seal.

2. An electric lamp as in claim 1 where each of the lamp caps surrounds a respective one of the seals both circumferentially and at a distal end thereof.

* * * * *